US006273350B1

(12) United States Patent
Kirby et al.

(10) Patent No.: US 6,273,350 B1
(45) Date of Patent: Aug. 14, 2001

(54) MATERIAL HANDLING APPARATUS

(76) Inventors: Richard M. Kirby; Arthur P. Burrows; Richard A. Mendonca, all of P.O. Box 989, Merced, CA (US) 95341-0989

( * ) Notice: Subject to any disclaimer, the term of this patent is extended or adjusted under 35 U.S.C. 154(b) by 0 days.

(21) Appl. No.: 09/228,834

(22) Filed: Jan. 12, 1999

(51) Int. Cl.[7] ..... B02C 19/22
(52) U.S. Cl. ..... 241/260.1
(58) Field of Search ..... 241/260.1

(56) References Cited

U.S. PATENT DOCUMENTS 4,344,580 * 8/1982 Hoshall et al. ..... 241/260.1
4,978,078 * 12/1990 Vadnay ..... 241/260.1
5,148,999 9/1992 Curfman et al. .
5,772,131 * 6/1998 Dal Maso ..... 241/260.1
6,092,750 * 7/2000 Kooima et al. ..... 241/260.1

FOREIGN PATENT DOCUMENTS

658205 * 6/1929 (FR) ..... 241/260.1
62-57303 * 11/1987 (JP) ..... 241/260.1

* cited by examiner

*Primary Examiner*—Mark Rosenbaum
(74) *Attorney, Agent, or Firm*—Worrel & Worrel

(57) ABSTRACT

A material handling apparatus having a substantially planar member with a central portion and an outer edge and wherein the cutting edge extends substantially to the outer edge of the substantially planar member and is scalloped including a series of convex arcs arranged in a plurality of segments of the series of convex arcs.

12 Claims, 1 Drawing Sheet

MATERIAL HANDLING APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a material handling apparatus and, more particularly, to such a material handling apparatus which is particularly well suited to the delivery of work materials to a predetermined point of discharge while processing those materials during such delivery.

2. Description of the Prior Art

A wide variety of environments exist within which materials of any of a wide variety of types must be delivered to a predetermined location and which, during such delivery, may be processed in any of a wide variety of respects. For example, it is known to mix constituent materials for a predetermined purpose during delivery to a discharge point. Thus, in the case of the preparation and delivery of concrete, it is known to mix the constituent materials including, in general, cement, gravel, sand, water and the like, until immediately prior to delivery to a discharge point.

Another environment within which constituent materials have been known to be mixed during such delivery is in the case of such end products as animal food, plant food, and a host of different end products which must be processed and intermixed to produce the desired resultant product. Such processes may be performed on a commercial basis internally within the plant which produces the end product or may, of necessity, need to be performed by the end user a relatively short period of time prior to consumption. A manufacturer may have the ability to construct and modify an assembly line, or processing line, for purposes of achieving the desired result. This capability may not be available to those constituting end users who must employ whatever equipment is commercially available for the desired purpose.

In the production of feed materials, whether at the manufacturing level or at the consumer level, it is known to use augers having portions operable to process fibrous material while mixing the constituent materials employed in producing the end product. For example, the Curfman et al. U.S. Pat. No. 5,148,999 is directed to an animal feed mixing system wherein an auger mounts a plurality of inserts having cutting edges positioned at spaced locations in notches therefor extending in spaced relation to each other about the peripheral edge of the auger flight. As stated in the Curfman et al. patent, the inserts coact with the sides of the mixer to cut and chop fibrous material so that it can be better intermixed with other feed components.

In practice, however, it has been found that the composition of such animal, or other materials, vary widely, whether specifically employed as animal feed or in the case of the multiplicity of other environments of usage. Consequently, the capability for processing such materials is similarly varied. This problem is particularly acute in those instances, as previously identified, wherein the specific composition consumed is produced by the end user. In such instances, the end user must mix a plurality of constituent components which vary widely in form, fiber content, resistance to severing or commutation, and may possess a host of other physical properties which may render difficult the production of the desired end product. As noted, a major limitation is the success with which the desired end products can be produced. An additional limitation, particularly for the end user, is the ability of the commercially available equipment to handle and adequately process the constituent components without damage thereto. For these reasons, frequently certain constituent materials must be separately mixed, or otherwise acquired, because the available commercial equipment is incapable dependably of accomplishing the desired result.

Still further, it is known that prior art material handling devices characteristically may require an inordinate amount of time in processing the materials to achieve the desired result. This is not only expensive, but may result in the optimum composition for the end product not being attained.

Therefore, it has long been known that it would be desirable to have a material handling apparatus which is widely adaptable to a host of operative environments within which one or more constituent materials must be processed to achieve a desired resultant end product; which operates to sever a plurality of constituent materials which may be of widely varying characteristics in order to achieve the desired result; which is operable more quickly and effectively to intermix constituent components to produce a result end product; which is particularly well suited to the production of feed materials, whether for animals, plant life, humans or in virtually any other operative environment; which can more effectively be employed by end users in producing the precise desired product to be consumed at the site of such consumption; and which is otherwise successful in achieving its operational objectives.

BRIEF SUMMARY OF THE INVENTION

Therefore, it is an object of the present invention to provide an improved material handling apparatus.

Another object is to provide such a material handling apparatus which is adapted to usage in a host of operative environments.

Another object is to provide such a material handling apparatus which is well suited to usage by both commercial producers of marketable products, as well as by the consumers at the site of consumption, whether immediately before such consumption or prior to being placed in storage for subsequent consumption.

Another object is to provide such a material handling apparatus which overcomes the deficiencies commonly associated with prior art material handling devices and is otherwise widely adaptable for broad usage in a host of specific operational situations.

Another object is to provide such a material handling apparatus which permits a multiplicity of constituent materials of widely varying character to be rapidly and effectively severed, or comminuted, and intermixed during delivery to a discharge location.

Another object is to provide such a material handling apparatus which permits a virtually unlimited number and type of processing devices to be rendered operable to achieve the results desired by the operator without any substantial hazard of break down, inordinate wear or operational failure which would otherwise limit, or interfere, with the operation.

Another object is to provide such a material handling apparatus which is unusually well suited to the production of animal feed from a plurality of constituent components of varying character permitting the operator broad discretion in selecting the constituent components and volume thereof at the site of such consumption without adjustment to, or reconfiguration of, the equipment so employed.

Still another object of the present invention is to provide such a material handling apparatus which operates rapidly and efficiently to sever and mix the constituent components comprising the ultimate product substantially without the operator having to consider the time of operation or effectiveness thereof.

Further objects and advantages are to provide improved elements and arrangements thereof in an apparatus for the purpose described which is dependable, economical, durable and fully effective in accomplishing its intended purposes.

These and other objects and advantages of the present invention are achieved, in the preferred embodiment of the present invention, in a material handling apparatus having a substantially planar member with a central portion and an outer edge and wherein a cutting edge is formed on said member extending substantially to said outer edge.

DETAILED DESCRIPTION OF THE INVENTION

Figure 1:
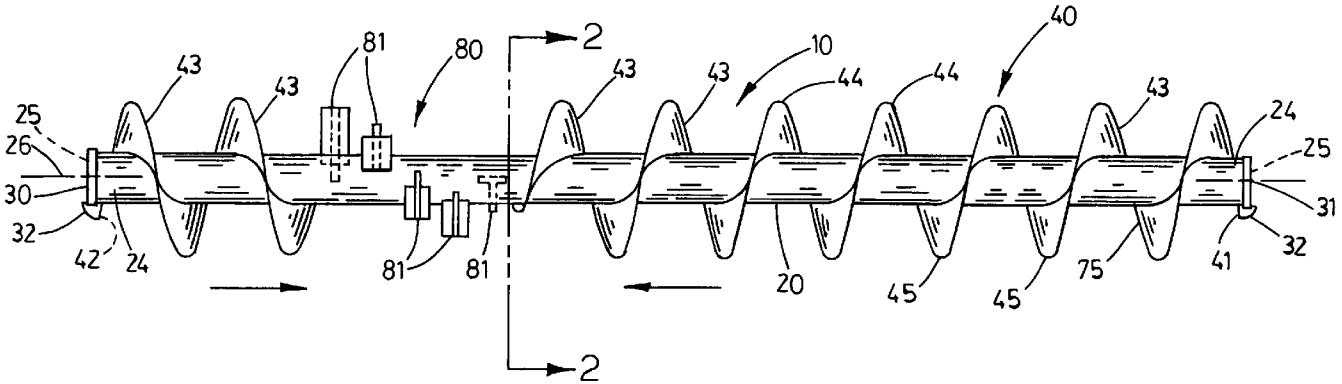
FIG. 1 is a side elevation of the apparatus of the present invention shown in a representative operative environment in use on an auger as employed in, for example, a feed mixing device.

Referring more particularly to the drawings, the apparatus of the present invention is generally indicated by the numeral 10 in FIG. 1.

The material handling apparatus 10 of the present invention is adaptable for use in a host of operative environments wherein one or more constituent materials must be conveyed to a delivery point and wherein the materials are to be nixed to produce a resulting product. In the operative environment shown herein, it will be assumed, for illustrative convenience, that the environment is an auger employed with a plurality of one or more other such augers in a feed processing device. For this purpose, it may be visualized, for illustrative convenience, that a plurality of the material handling apparatuses 10 shown in FIG. 1 are mounted in an animal feed mixer, not shown. Conventionally, such animal feed mixers consist of a plurality of conventional augers individually mounted for rotation about horizontal axes parallel to each other and into which the constituent components are deposited for purposes of processing and delivery to a discharge location. Since the specific combination of conventional augers, their construction and the types of animal feed mixers, may vary and they may be mounted on trucks or trailers or be embodied in fixed mixing stands, these details need not be shown or described herein. Accordingly, only one such material handling apparatus 10 is shown and described herein.

The material handling apparatus 10 of the present invention has a central mounting member, or shaft, 20 in the preferred embodiment consisting of a tubular steel, or other metal, pipe, as shown in the drawings. Thus, the shaft has a cylindrical wall 21 having an outer cylindrical surface 22 and an interior cylindrical surface 23. The shaft has opposite end portions generally indicated by the numerals 24. Each of the opposite end portions has a circular mouth or opening 25. The shaft has a longitudinal axis, or axis of rotation, generally indicated by the numeral 26.

A left end plate 30 is mounted in covering relation to the opening 25 of the opposite end portion 24 on the left in FIG. 1. Similarly a right end plate 31 is mounted in covering relation to the opening 25 of the opposite end portion 24 on the right as viewed in FIG. 1. The left and right end plates are mounted by any suitable means, such as by welding. The left end plate and right end plate each mount a wiper blade 32 extending substantially radially from the end plate, as shown in FIG. 1, with a portion thereof extending laterally of its respective left or right end plate. An auger blade generally indicated by the numeral 40 in FIG. 1 is mounted on and extends about the central mounting shaft 20 forming, generally, a helix and extending from a right terminus 41 preferably connected to the wiper blade 32 thereof to a left terminus 42 on the left as viewed in FIG. 1 preferably connecting with the wiper blade 32 of the left end plate 30. The auger blade is, in the preferred embodiment, fabricated of steel.

Depending upon the particular environment of usage, the auger blade 40 may extend continuously the entire length of the central mounting shaft 20. Alternatively, the auger blade may be composed of discontinuous segments, as shown in FIG. 1. The embodiment shown in FIG. 1 will hereinafter be described in greater detail with respect to the gap therein bounded by the discontinuous segments of the auger blade.

The auger blade 40 is composed of a plurality of auger flights 43 constituting, in essence, a three hundred sixty degree (360°) extension of the auger blade about the central mounting member 20. Thus, the auger blade is composed of a plurality of auger flights. Each of the auger flights can be viewed as having an upper extremity 44 and an opposite lower extremity 45.

Figure 2:
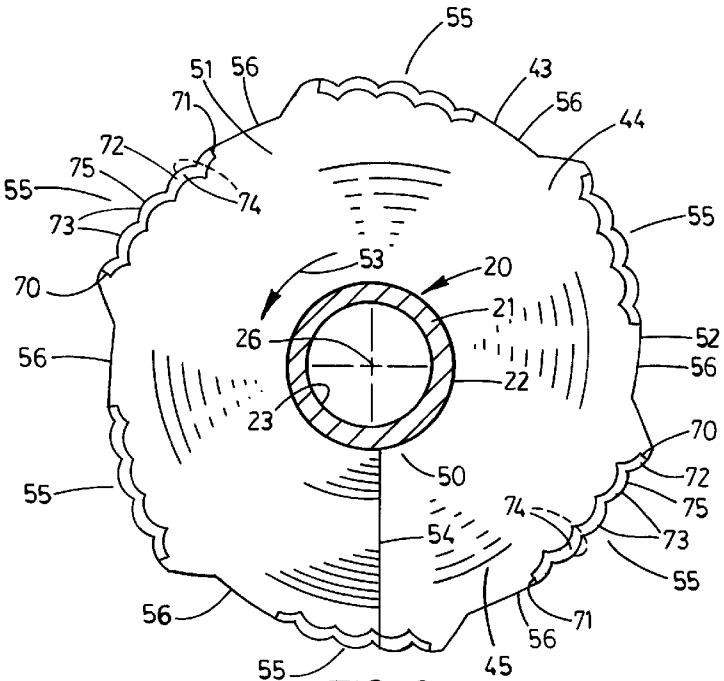
FIG. 2 is a transverse vertical section taken on line 2—2 in FIG. 1.

Each of the auger flights 43, as may best be seen in FIG. 2, consists of a central portion 50 which is mounted on and extends about the central mounting shaft 20 and an outer portion 51 extending to a peripheral edge 52 for each auger flight 43. In the illustrative embodiment hereof, the central mounting shaft 20 and its auger blade 40 are adapted to be rotated by suitable drive means, not shown, in a counterclockwise direction, as viewed in FIG. 2, and as indicated by arrow 53. Depending upon the operative environment and the desired operative result, the central mounting shaft and its auger blade can be rotated, instead, in a clockwise direction if desired. For illustrative convenience, as shown in FIG. 2, the auger flight 43 has a sectioned edge 54. However, it will be understood that, depending upon the specific embodiment of the auger blade, the auger blade may extend the entire length of the central mounting shaft. Each auger flight 43 has a plurality of cutting zones or segments generally indicated by the numeral 55 which are spaced from each other by intermediate zones or segments 56. Thus, as shown in FIG. 2, the representative auger flight 43 has a total of six cutting zones or segments 55 spaced from each other about the peripheral edge 52 of the auger flight.

Each cutting zone or segment 55 of each auger flight 43 has an apex or leading end portion 70 and an exit or trailing end portion 71. Thus, in any given rotation of the central mounting shaft 20 and auger blade 40, the apex or leading end portion 71 of each cutting zone or segment 55 leads in the direction of rotation indicated by arrow 53 while for each such cutting zone or segment, the exit or trailing end portion 71 follows in such rotational movement. Each of the cutting zones or segments 55 has a scalloped cutting edge 72 extending between the leading end portion and the trailing end portion of the specific cutting zone or segment. Each scalloped cutting edge is composed of a plurality of convex portions 73 having opposite beveled surfaces 74 forming the cutting edge at the terminus 75 thereof.

Preferably, during construction, the peripheral edge of the auger blade 40 is scalloped as the auger blade is being cut from its parent material which is usually ferrous steel. The auger blade is then beveled along the scalloped area and at the notch immediately preceding the scalloped area. The beveled areas are then treated with a hard facing material to decrease the wear associated with usage. The auger blade is then formed into its desired helical form and mounted by any suitable means on the central mounting shaft 20.

In those embodiments of the material handling apparatus 10 in which the auger blade 40 is discontinuous along the length of the central mounting shaft 20, the discontinuous nature of the auger blade leaves a gap or discontinuous portion 80. Again depending upon the desired embodiment of the invention, a plurality of kicker plates or assemblies 81 are mounted, as by welding, on the outer cylindrical surface 22 of the cylindrical wall 21 extending outwardly therefrom in spaced relation to each other and about the outer cylindrical surface in accordance with a predetermined arrangement. The kicker plate assemblies can be of any suitable construction and are otherwise of conventional form.

As best shown in FIG. 2, each of the cutting zones or segments 55 is preferably canted relative to the axis of rotation 26 of the central mounting shaft 20 so that the leading end portion 70 extends farther outwardly from the axis of rotation than does the trailing end portion 71 of the given cutting zone or segment.

OPERATION

The operation of the described embodiment of the subject invention is believed to be clearly apparent and is briefly summarized at this point.

As heretofore discussed, the material handling apparatus 10 of the present invention can be constructed in a multiplicity of different forms for usage in a wide variety of operative environments. In the illustrative embodiment, the material handling apparatus is mounted within an otherwise conventional animal feed mixer which may be borne by a truck, trailer or be a fixed emplacement. Such animal feed mixers characteristically mount a plurality of augers within a mixing chamber in spaced, substantially parallel relation and typically horizontally disposed. The augers are rotated about their respective longitudinal axes by any suitable drive means. The materials which are to be processed and combined to form the animal feed are deposited in the mixing chamber and cut against the wall of the chamber during such rotation of the augers. Simultaneously, the resultant material is conveyed to dispense the resultant animal feed at a discharge location. Conventionally, the augers of such animal feed mixing devices could not accommodate, or in other words process, certain types of materials which were resistant to such processing. Alternatively, certain of the constituent components have conventionally had to be mixed separately from the main feed constituents and then added to the animal feed mixing device in order to achieve the desired result and avoid damage to the animal feed mixing devices.

While it has been known conventionally to mount cutting blades on the augers of such feed mixing devices, such as shown in the Curfman et al. U.S. Pat. No. 5,148,999, such prior art devices characteristically suffered from both an inability nonetheless to process certain types of materials as well as to evidence susceptibility to breaking of the portions of the auger blades deployed for such cutting. Thus, blade inserts such as shown in the Curfman et al. patent have shown a tendency to break off during usage due to material failure such as the loss of a weld or mechanical fastener over time during usage. Such failures create a substantial hazard in that the broken inserts and fasteners become so intermixed with the animal feed as to be passed on for consumption by the animals therefore causing injury or other damage.

By contrast, the cutting zones or segments 55 of the material handling apparatus 10 of the present invention have been found to operate substantially more effectively in cutting a wide variety of materials or constituent substances employed in the production of the particular animal feed to be used. At the same time, the cutting zones or segments 55 of the material handling apparatus of the present invention are durable, resistant to wear and damage and have been found to avoid the breakage or material failure found in conventional devices.

While the preferred embodiment of the invention employs convex portions 73 constituting the scalloped cutting edge 72 of each of the cutting zones, or segments, 55, the scalloped cutting edge can also be formed from concave portions or from a combination thereof as may be best suited to the particular usage and environment of operation for which the material handling apparatus is employed.

During operation, the material handling apparatus 10 is rotated in a counterclockwise direction as shown in FIG. 2 and as indicated by arrow 53. The cutting zones or segments 55 are thereby drawn into engagement with the constituent components contained in the mixing chamber and operate to both sever and mix the constituent materials during such rotation. The severing operation is performed both by direct contact with the constituent components as well as by causing the constituent components to be drawn between the cutting zones or segments and the back wall and bottom of the mixing chamber of the animal feed mixing device. The apex or leading end portion 70 of each cutting zone or segment 55 cuts the constituent components while the trailing convex portions 73 relieve the pressure thereon until the leading end portion 70 of the next segment 55 comes into contact therewith.

Simultaneously, as mounting shaft 20 and auger blade 40 are rotated in the direction indicated by arrow 53 in FIG. 2, the constituent materials are moved toward the gap 80 and the kicker plates or assemblies 81, as indicated by the arrows shown in FIG. 1. Upon reaching the gap, the kicker plates propel the resulting severed, or comminuted, material toward the back wall of the animal feed mixer for handling in an otherwise conventional manner.

The kicker plates or assemblies 81 extending outwardly from the central mounting shaft 20 within the gap 80 are employed simply to throw the materials with which they come into contact farther outwardly from the material handling apparatus for purposes of achieving the desired mixing result.

Therefore, the apparatus of the present invention is widely adaptable to a host of operative environments within which one or more constituent materials must be processed to achieve the desired resultant end product; operates to sever, or comminute, a plurality of constituent materials which may be of widely varying characteristics in order to achieve the desired end result; is operable more quickly and effectively to intermix constituent components to produce a resultant end product; is particularly well suited to the production of feed materials, whether for animals, plant life, humans or in virtually any other operative environment; is uniquely well suited to usage by end users in producing the precise desired product to be consumed at the site of such consumption; and is otherwise successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to secure by Letters Patent is:

1. A material handling apparatus comprising a substantially helical auger blade having a central portion and an outer edge and wherein a cutting edge is formed on said auger blade extending substantially to said outer edge and said cutting edge has a curved configuration through at least a portion of its length and wherein said cutting edge is scalloped including a series of convex arcs at said outer edge of the auger blade.

2. The material handling apparatus of claim 1 wherein the auger blade extends in a series of flights along a mounting member about which said central portion of the auger blade is extended.

3. The material handling apparatus of claim 2 wherein each of said flights of the auger blade has a periphery which has a plurality of segments of said series of convex arcs extending about the periphery thereof.

4. The material handling apparatus of claim 3 wherein said segments of each flight are spaced from each other about said periphery thereof.

5. The material handling apparatus of claim 4 wherein said segments of each flight are substantially equally spaced about said periphery of each flight.

6. The material handling apparatus of claim 2 wherein said mounting member defines an axis of rotation substantially about which said auger blade is adapted to be rotated during operation and wherein each of said flights of the auger blade has a periphery which has a plurality of segments of said series of convex arcs extending about the periphery thereof.

7. The material handling apparatus of claim 6 wherein said segments of each flight are spaced from each other about said periphery thereof.

8. The material handling apparatus of claim 4 wherein said segments of each flight are substantially canted relative to said axis of rotation.

9. The material handling apparatus of claim 8 wherein said segments of each flight are substantially canted at substantially the same attitudes relative to said axis of rotation.

10. The material handling apparatus of claim 9 in which said auger blade is adapted to be rotated about said axis of rotation and wherein said segments of each flight are substantially canted so as to form a leading edge and a trailing edge for each of said flights relative to said direction in which said auger blade is adapted to be rotated.

11. The material handling apparatus of claim 10 in which said leading edge extends farther from said axis of rotation than said trailing edge.

12. The material handling apparatus of claim 11 wherein said auger blade is adapted for operation to transport material substantially along said axis of rotation and, during said operation, said segments sever and mix said material as the auger blade is rotated substantially about said axis of rotation.

* * * * *

UNITED STATES PATENT AND TRADEMARK OFFICE

CERTIFICATE OF CORRECTION

PATENT NO. : 6,273,350 B1
DATED : August 14, 2001
INVENTOR(S) : Richard M. Kirby; Arthur P. Burrows; Richard A. Mendonca It is certified that error appears in the above-identified patent and that said Letters Patent is hereby corrected as shown below:

Column 3,
Line 42, delete "nixed" and substitute -- mixed --

Signed and Sealed this

Twenty-ninth Day of January, 2002

*Attest:*

*Attesting Officer*

JAMES E. ROGAN
*Director of the United States Patent and Trademark Office*